US011766598B1

(12) United States Patent
Jungclaussen

(10) Patent No.: US 11,766,598 B1
(45) Date of Patent: Sep. 26, 2023

(54) SURFING SIMULATOR

(71) Applicant: Jens-Peter Jungclaussen, San Francisco, CA (US)

(72) Inventor: Jens-Peter Jungclaussen, San Francisco, CA (US)

(73) Assignee: Jens-Peter Jungclaussen, San Francisco, CA (US)

( * ) Notice: Subject to any disclaimer, the term of this patent is extended or adjusted under 35 U.S.C. 154(b) by 76 days.

(21) Appl. No.: 17/194,007

(22) Filed: Mar. 5, 2021

Related U.S. Application Data

(60) Provisional application No. 63/111,334, filed on Nov. 9, 2020.

(51) Int. Cl.
*A63B 69/00* (2006.01)
*A63B 5/11* (2006.01)
*A63B 26/00* (2006.01)

(52) U.S. Cl.
CPC ..... *A63B 69/0093* (2013.01); *A63B 5/11* (2013.01); *A63B 26/003* (2013.01)

(58) Field of Classification Search
CPC .... A63B 5/11; A63B 4/00; A63B 5/00; A63B 5/08; A63B 5/12; A63B 5/16; A63B 6/00–02; A63B 21/22; A63B 21/222; A63B 21/4027; A63B 22/0048–2022/0051; A63B 2022/206; A63G 1/00–48; A63G 4/00
See application file for complete search history.

(56) References Cited

U.S. PATENT DOCUMENTS 4,489,933 A * 12/1984 Fisher ..... A63B 5/11 482/28
4,509,743 A * 4/1985 Lie ..... A63B 22/14 482/71
4,880,226 A * 11/1989 Krantz ..... A63B 21/4015 482/29
4,953,858 A * 9/1990 Zelli ..... A63B 21/023 482/71

(Continued)

FOREIGN PATENT DOCUMENTS

EP 2 347 811 3/2001

OTHER PUBLICATIONS

Sauerland-Spielgeraete.de, "Turntable F-320" https://www.sauerland-spielgeraete.de/shop/Produktkatalog/Bewegliche-Geraete/Drehscheibe-F-320.html, retrieved October 7, 2022, 12 pages.

*Primary Examiner* — Loan B Jimenez
*Assistant Examiner* — Catrina A Letterman
(74) *Attorney, Agent, or Firm* — Hickman Becker Bingham Ledesma LLP

(57) ABSTRACT

An apparatus and method of using the same for simulating surfing skateboarding, snowboarding or the like. The apparatus comprises a platform capable of supporting a user such as a continuous elastic surface such as trampoline or similar. A support is coupled to the platform for holding the platform. The apparatus further comprises a bearing or similar assembly coupled to the support for allowing the platform to rotate about an axis which is displaced a distance from the user while standing atop the platform during simulation thus simulating bottom and top turns. The apparatus further comprises a stand coupled to the bearing for securely supporting the bearing and tilting the axis of rotation.

17 Claims, 21 Drawing Sheets

(56) References Cited

U.S. PATENT DOCUMENTS

| | | | | | |
|---|---|---|---|---|---|
| 5,062,629 | A * | 11/1991 | Vaughan | A63B 22/18 | 482/51 |
| 5,613,922 | A * | 3/1997 | Hsiang | A63B 69/0097 | 482/28 |
| 2002/0010061 | A1* | 1/2002 | Frank | A63G 1/14 | 482/142 |
| 2004/0198507 | A1* | 10/2004 | Corbalis | A63B 69/0093 | 472/89 |
| 2013/0210590 | A1* | 8/2013 | Publicover | A63B 67/002 | 482/110 |
| 2018/0085650 | A1* | 3/2018 | Dalton | A63F 13/428 | |
| 2021/0213344 | A1* | 7/2021 | Gouzenko | A63B 21/023 | |

* cited by examiner

SURFING SIMULATOR

FIELD OF THE INVENTION

The present invention is related to the field of sporting equipment, particularly surfing simulators and trainers.

BACKGROUND

Surfing trainers and simulators have existed to satisfy the need of many who do not have access to locations where they can regularly surf, train or otherwise develop their skills. These simulators help users develop the skills and fitness to train the surf-motion on a simulator on land, but are often lacking in many respects. None of these accurately simulate a moving wave of water, accurately simulate surfer's movement on the face of a wave, nor do they necessarily develop the skills and fitness for surfing. Existing surfing simulators range from small wiggle boards to wave pools with artificial waves.

Wiggle boards train a user's static balance on unbalanced ground to stay in an as-balanced and upright position, basically on an imagined plumb line, as possible to not fall. The board on such a device sits on a roller, airbags, springs, or a motorized bull machine. Skateboards are good for surf training but tend to be dangerous as falling on a hard surface can be harmful. In addition, skateboards do not train how to "takeoff" on a wave.

At the other end of the scale there exist small mechanical continuous waves simulators pumping water over a shaped surface or the full-scale artificial waves like the Kelly Slater Surf Ranch which do simulate real waves reasonably accurately but are extremely expensive to build and run. These devices are usually inaccessible to the average surfer.

The wiggle board assumes that surfing is simply a question of good balance—it is not. As soon as a surfboard is in motion on a wave, it becomes very stable. Therefore, once this skill is mastered the wiggle board is not a very good trainer for advanced surfers.

There therefore exists a need for a cost-effective surfing simulator available to average surfers that simulates other conditions of surfing rather than just balance.

SUMMARY

Disclosed is an apparatus and method of using the same for simulating surfing skateboarding, snowboarding or the like. The apparatus comprises a platform capable of supporting a user, in some embodiments it is a continuous elastic surface such as trampoline with it's frame or similar elastic surface. In other embodiments it is firm or non-elastic platform, sometimes in the shape of a surfboard or similar riding surface. The apparatus has a support coupled to the platform for holding the platform. It further comprises a bearing or similar assembly coupled to the support for allowing the platform to rotate about an axis which can be displaced a distance from the user while standing atop the platform during simulation thus simulating bottom and top turns. The apparatus further comprises a stand coupled to the bearing for securely supporting the bearing and allowing the platform to rotate about a tilted axis without toppling the apparatus.

The support of the apparatus can be done in various ways, such as mounting legs or other means. The bearing surface can also be implemented in various ways to implement captured rotation, such as the use of tracks or wheels in various implementations. This can be done mechanically in combination with gravity to maintain the integrity of the apparatus.

In other embodiments, the platform can be attached by an arm at one end and a fixed bearing at some distance displaced from the user to allow rotation and surf simulation, perhaps with a secondary bearing for movement of the platform.

In another embodiment, an adapter is disclosed which allows the adaptation of a standard commercially-available trampoline to form the disclosed surfing simulator.

In other embodiments, various means of captured rotation of a platform such as a trampoline are disclosed.

Methods for use of the surfing simulators disclosed herein are also described for simulating various surfing and skateboarding maneuvers.

BRIEF DESCRIPTION OF THE DRAWINGS

The novel features of the invention are set forth in the appended claims. However, for purpose of explanation, several embodiments of the invention are set forth in the following figures.

DETAILED DESCRIPTION

Figure 1:
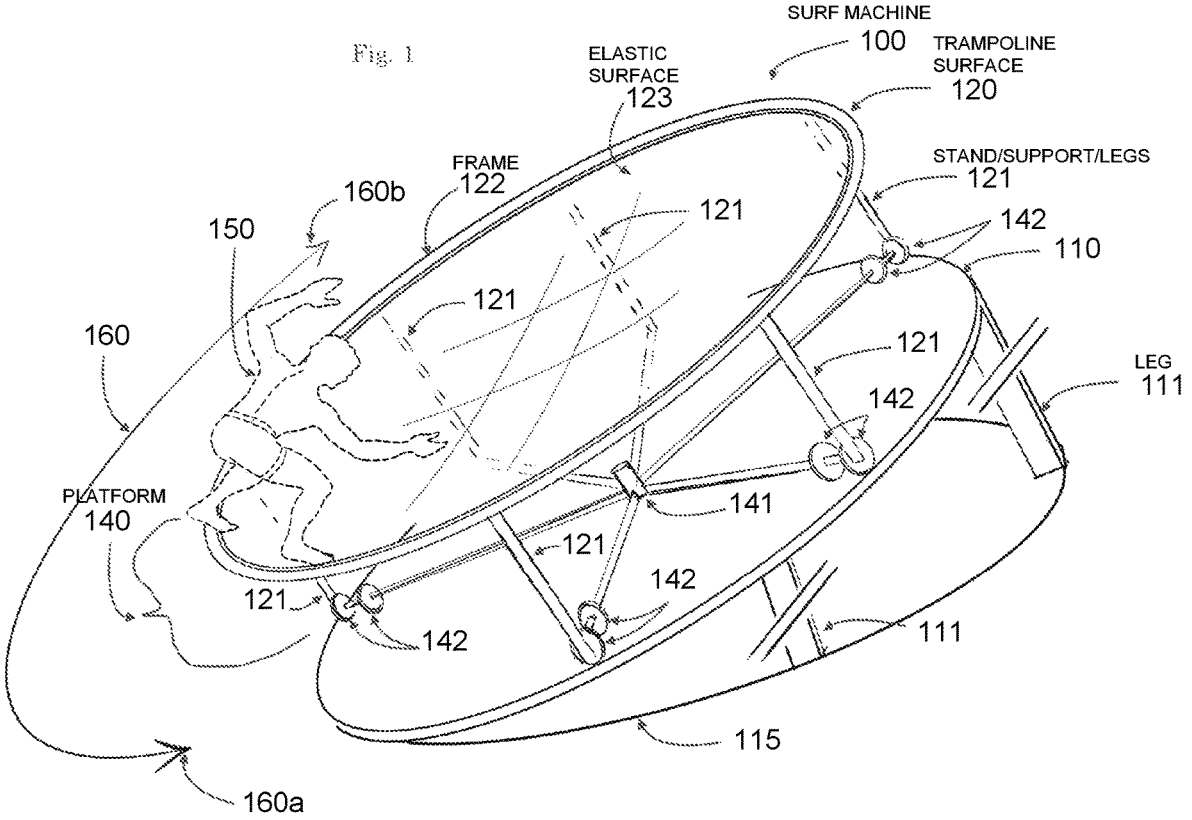
FIG. 1 shows a surf machine in some embodiments of the present invention.

In the following description, numerous details are set forth for purpose of explanation. However, one of ordinary skill in the art will realize that the invention may be practiced without the use of these specific details. In other instances, well-known structures and devices are shown generally without a lot of detail in order to not obscure the description of the invention with unnecessary detail.

For the remainder of this disclosure the terms surf, surfer, surfing, surfboard (or simply "board") and similar cognates will be used. For the purposes of this disclosure, those terms are meant to refer to ALL of the surfing and related disciplines where relevant to this disclosure. Thus, surfing can refer to, but is not limited by, the following: skateboarding, snowboarding, windsurfing, kitesurfing, and stand-up surfing (or paddling). In general, surfing will refer to any sport where the surfer (user, rider, kitesurfer, SUPer, etc. . . . ) riding a board (surfboard, skateboard, snowboard, etc. . . . ) or similar vehicle and is generally standing in a straddling position with his board perpendicular to his body but forward facing. In such a position, the surfer often rides the vehicle on an inclined surface, such as the surface of waves or swell on water, the asphalt on a hilly road or wood on a half-pipe, snow on a mountain slope or snow half-pipe. The surfer can either ride "regular foot" (left foot forward relative to direction of travel), or "goofy foot" (right foot forward).

Also, for the purposes of this disclosure the terms simulator and trainer will be used. For these purposes, the terms are interchangeable since the apparatus achieves objectives for both simulation and training to the actual sport of surfing.

The objective of various embodiments of the present invention is to simulate carving rather than just balancing to stay on the board as it is for the wiggle board and similar devices. As previously stated, as soon as a surf board is in motion, it becomes very stable and balancing skills become less relevant to the act of surfing. The objective of the present invention is to allow the user to experience the full motion of surfing in a more realistic and relevant way, especially for advanced surfers. These skills include simulating the sensation of going down the wave once the wave is "caught", training the surfer how to use his dynamic balance of letting his center of gravity fall into the center of a turn on the wave face, and turning back upwards on the wave. This also includes letting the surfer's legs travel faster than the center of gravity by which the feet, and with that the board, travel faster than the center of gravity of the body is traveling down and with the wave.

The objective of various embodiments of this invention is to not simply train the surfer to ride down the wave in a straight line, but to pivot up and down the face of the wave (or asphalt, half-pipe or snowy mountain), going into a deep bottom turn, leaning the surfer's weight on the wave facing rail of the board to drive it through the bottom turn, and back up into the lip (top) of the surface of the wave as vertical as possible. Described embodiments also train how to then drop down from the top of the wave, down to the bottom and back up to the lip of the wave again. As will be discussed, in described embodiments, a circular motion is used to simulate the motion on the face of the wave as the center of the user's gravity travels with the user down the face of the wave.

The objectives of these embodiments are to allow users to experience this moment of taking off on a wave, dropping into a wave, getting onto their feet, and driving the feet through the bottom turn in a way that generates, and not loses, energy and velocity while surfing. The generation of energy by weight transfer is thus teachable to users using embodiments of the present invention. The ideal weight transfer for the particular user can be learned over time through repetition in embodiments of the present invention given that the cost of such a device would be well within reach of the average surfer.

An embodiment of the present invention is shown as surf simulator/trainer machine 100 (hereinafter "surf machine") in FIG. 1, which a user or surfer 150 can use to develop his carving skills as set forth above. Surf machine 100 is comprised of a base structure, such as a platform, plane or surface 110 set on an inclined plane relative to a surface 115, the ground, floor or other solid surface. Surface 110 may be solid and can be made of any suitable material —wood, metal, composite or similar to provide support for additional apparatus described herein. Several embodiments described herein are intended for end-user installation and use. These embodiments contemplate using consumer grade components, such as trampolines and associated products commercially available to consumers with lighter gauge materials and construction that used in the commercial context such as in theme parks, playgrounds, etc. . . . . These embodiments, allow, for example, user installation at locations of his own choosing (backyards, garages, playrooms, home gyms, etc. . . . ) and may not have as rigid regulatory requirements as in the commercial context. Portability is also facilitated as opposed to commercial units which may be manufactured for fixed installation. Also, as will be described, user-adjustability is enabled, for example, simulating different size waves, for different users (beginners v. experts), and different radii of turns to be simulated.

In another embodiment, surface 110 might simply be a circular rail which provides the support for the additional apparatus discussed herein. Surface 110 is set at the incline by stand or legs 111, which in some embodiments can be fixed or in others telescoping or adjustable height, such as by spring pins. This allows the incline of surface 110 and angle of machine 100 to be user-adjustable. This user-adjustability allows training for different types of surfing conditions, for example, larger or steeper waves or other riding surfaces. In other embodiments, 110 can be mounted on a surface such as a flat surface or inclined surface, such as a hill or a dune, to provide an inclined plane.

Resting atop plane 110 in this embodiment is platform 140 upon which a user can ride during simulation. In this embodiment, 140 is a round or circular trampoline assembly which may be a round trampoline such as those commercially available with the modifications described herein. In this embodiment, the diameter of the assembly can be roughly eight feet, but any suitable diameter in a reasonable range to simulate various wave conditions. It is contemplated that useful apparatus will have a turning radius ranging between six and sixty feet in diameter for different simulation/training scenarios. Various sizes can be used according to use of the simulator (e.g. ability of the user to start rotation of the apparatus, and/or size of wave to be simulated, and/or bottom turns desired to be simulated).

Platform 140 has a typical trampoline surface 120 which is comprised of a frame 122 and an elastic surface 123 as is common in most commercially available trampolines. The surface 123 can be elastic through choice of elastic material only, or elastic material in combination with elastic structures such as springs, bungee cords, or the like as is known. The elastic nature of the elastic surface 120 simulates the elasticity and resistance on a board that a user 150 experiences when surfing on water. This allows the user 150 to "push" off the resistance and have feedback which is similar to surfing a board on water and develop the fitness for and muscle memory of doing the same.

In other embodiments, such as 200 discussed below, the surface 120 of platform 140 can be non-elastic and comprised of a solid or firm material, according to desired application. In yet another embodiment, the platform may be a pie slice of a circle which is rotatably mounted in the manner described herein. In either the continuous or the slice embodiments, the remaining material of the platform that the user is not standing upon can act as a safety mechanism in the event that the user leans too far towards the axis of rotation and falls.

As is standard in commercially-available trampolines, assembly 140 further comprises a stand or support comprising legs 121 which are coupled to frame 122 to provide support for the surface 120. Assembly 140 is further modified in the following way. It is rotatably coupled to base structure 110 using some sort of bearing assembly so that it rotates about a central axis 141 on base structure 110 but yet does not detach from the underlying structure. Because the trampoline is round, it can be so rotatably coupled in any number of ways. In this embodiment, bearing assembly 142 is comprised of wheels affixed to support legs 121 in some fashion.

Legs 121 of assembly 140 couple to base structure 110 at axis 141, in this embodiment, using a central structure with a bearing surface to allow captured rotation of surface 120 in directions 160 (clockwise 160*b* or counterclockwise 160*a* as shown). The weight of assembly 140 is thus borne on bearing wheels 142 as they ride on surface 110 and assembly 140 rotates about an axis 141. In this embodiment, surface 110 has a rail on its edge that captures assembly 140 by gravity and allows it to rotate upon using wheels 142 without becoming detached from the underlying structure. In alternative embodiments, other rolling hardware and tracks or other retention mechanisms may allow such captured rotation about an axis 141, for example, a central axis with a bearing surface at axis 141, but lacking any rail.

In summary, various embodiments of the present invention may optionally include, but not be limited to, one or more of the following in surf machine 100:

wheels on spokes on platform with a center axis;

wheel assembly running in a rail without center axis;

a solid surface;

a solid surface with extra small rotating platform;

an elastic surface; and an elastic surface with extra small rotating platform.

The rotation of assembly 140 above surface 110 allows a user to simulate the takeoff and carving motions as described above. A user 150 can stand the edge of the elastic portion 123 of surface 120 while the machine 100 is not in motion either at the top of the device to get a "running start" or start at the bottom to "fakey" or weight transfer (as on a skateboard or snowboard half-pipe), to get the apparatus moving. This "fakey" (back and forth weight transfer motion), especially in the forward moving position, approximates the carving motion of a surfer on a wave. Thus, by repetitively doing this motion, the surfer develops the proper techniques and fitness for real surfing. The direction of travel, counterclockwise 160*a* (for a goofy foot surfer) is shown in the FIG. 1 for simplicity, it can be appreciated by one skilled in the art that the apparatus can be used in the clockwise 160*b* (regular foot) direction as well. Because the surface 120 is tilted, the surfer 150 simulates a wave or other sloped riding surface.

For surf simulation by a user, axis 141 is so chosen in various embodiments and implementations of the present invention so as to simulate actual surfing, skateboarding, etc. . . . . In those instances, the user typically desires to train for executing maneuvers such as bottom and top turns (turns on the face of a wave or incline). The turning radii of such turns corresponds with the distance between a user mounted or standing on the platform 140 and the axis 141. While there are situations where the user may desire to pivot in place (a "180" or a "360"), surf machine 100 is contemplated to be often used where the position of axis 141 is displaced from the position of the user rather than coincident. That distance, the radius of the rotational path of the user on platform 140, corresponds with the radius of the bottom or top turn desired to be simulated.

The angle of the axis 141 (and platform 142 upon which the user is atop) simulates the angle of the wave face or other inclined plane (dirt, snow, asphalt, etc. . . . ) that the surfer desires to simulate. With a continuous surface such as a trampoline as disclosed herein, while it is contemplated that the user will start at the edge of 140, in some simulations, the user can simply step closer towards the axis 141 to simulate tighter (smaller radius) turns. In other embodiments, other means or adjusting this turn radius is contemplated within the spirit and scope of the present invention, such as adjustable arms or similar, for various use cases.

The fakey motion by surfer 150 on surf machine 100 can continue so that the surfer 150 can completely rotate assembly 140 while riding upon it. If the surfer 150 uses her weight correctly she can drive up to the other side of surface 110, come around, and back down. This allows additional aspects of simulating wave riding for training, for example, of riding down the face of a wave and doing cutbacks (turns at the apex and trough of the wave). This also allows the user to repeat the same motion to continuously work out and further develop skills and fitness.

In another usage scenario, use of surf machine 100 may proceed as illustrated in FIGS. 5A-5I, which show user 150 in various positions on surf machine 100 as successive points in time for a goofy-foot surfer. It is understood that a regular surfer will use the apparatus facing the opposite direction with machine 100 rotating the opposite direction (clockwise). Initially, the user 150 may be standing or laying on the apparatus to simulate paddling into the wave—FIG. 5I. User 150 can be at the top of the machine relative to its tilt for this phase. The user 150 then "pops-up" or assumes a standing position as shown at the time in FIG. 5A to start a surf simulation session. This puts the user 150 on top of the wave (surf machine 100) the weight is put onto the front foot, and the back leg has little to no weight, knee laying down on the machine 100's surface (simulating the board on a moving wave.

Subsequently, machine 100 rotates counterclockwise approximately 90 degrees. Then, the user 150 rotates ⅔ down the face of machine 100 leaning the body toward the center of the machine touching the center with the backhand as shown on FIG. 5C. Subsequently in time, as shown on FIG. 5D, user 150 reaches the bottom of the rotation of machine 100. Subsequently, user 150 transfers weight onto his backfoot, and unweights the front foot (so that his feet almost feel like they're slipping under his body), with his upper body is still leaning in to the center of the machine at FIG. 5E as he starts his progress back up the machine (wave) during rotation.

Figure 5A:
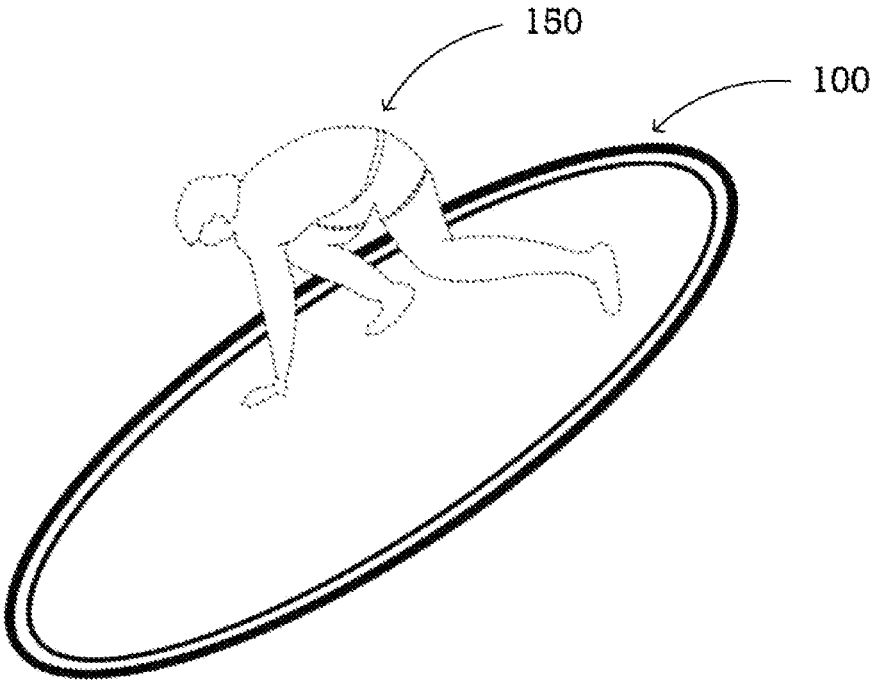
FIGS. 5A-5I show a user (surfer) using a surf machine at various phases of use for a single bottom and top turn combination on a simulated wave face.
Figure 5B:
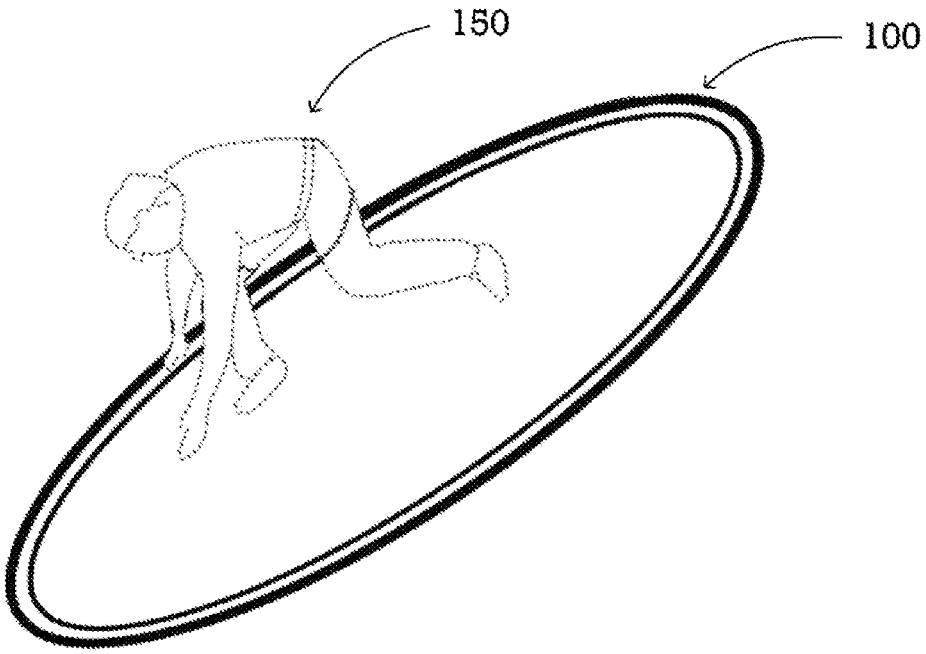
Figure 5C:
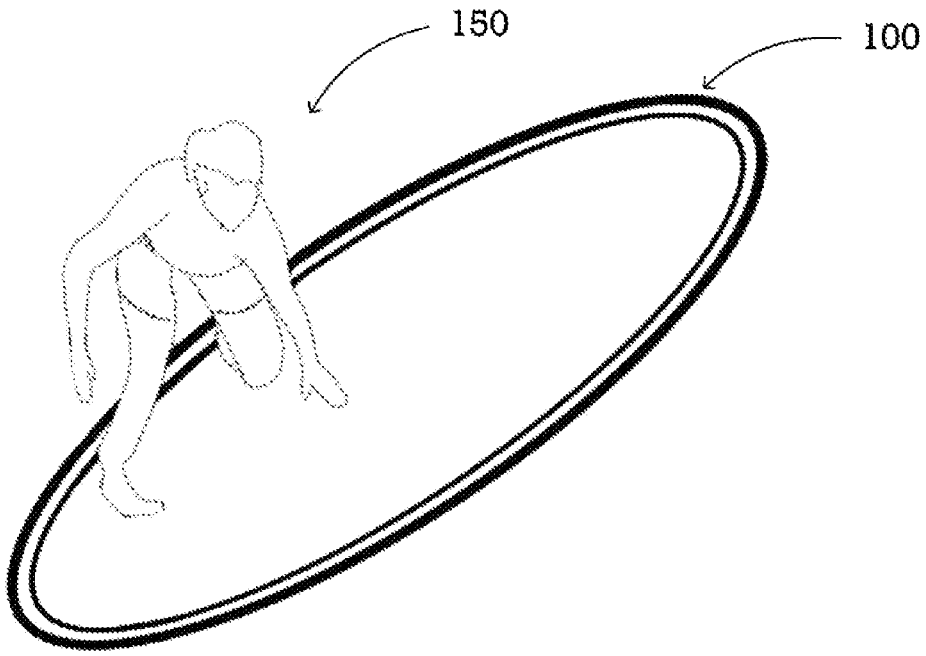
Figure 5D:
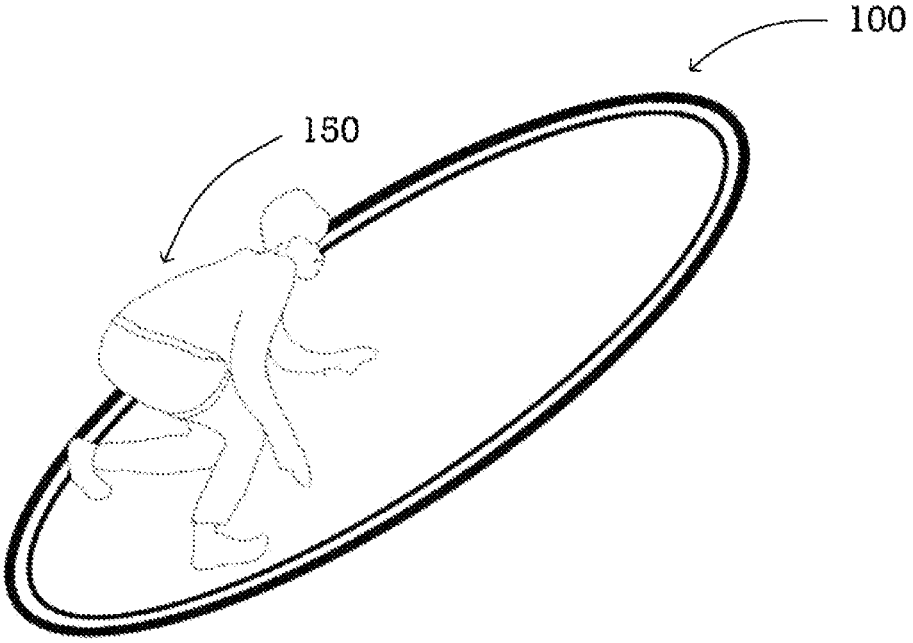
Figure 5E:
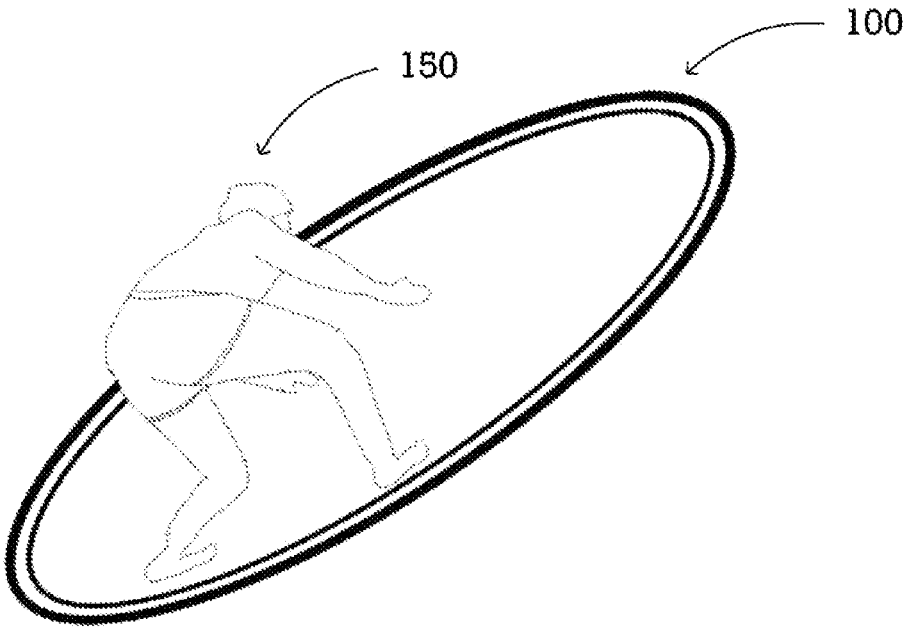
Figure 5F:
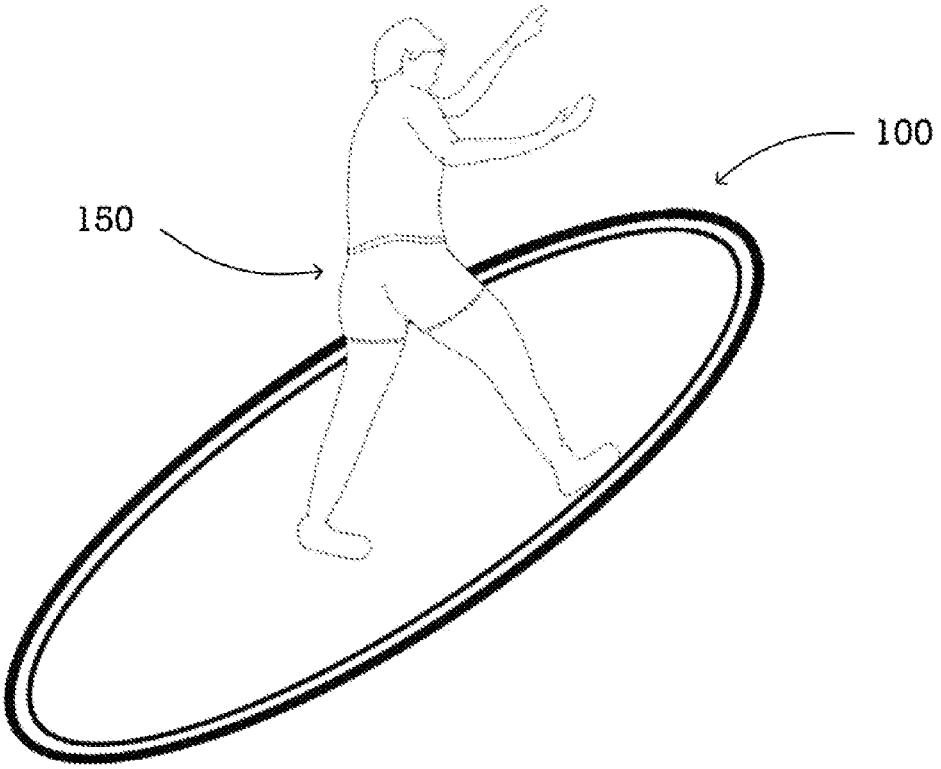
Figure 5G:
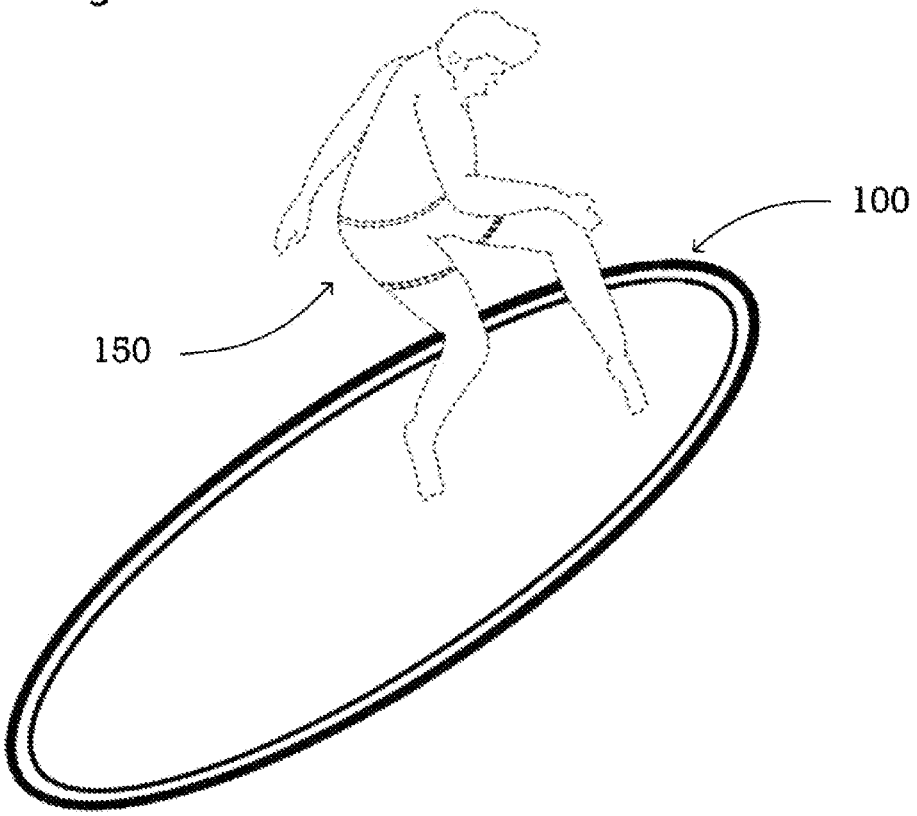
Figure 5H:
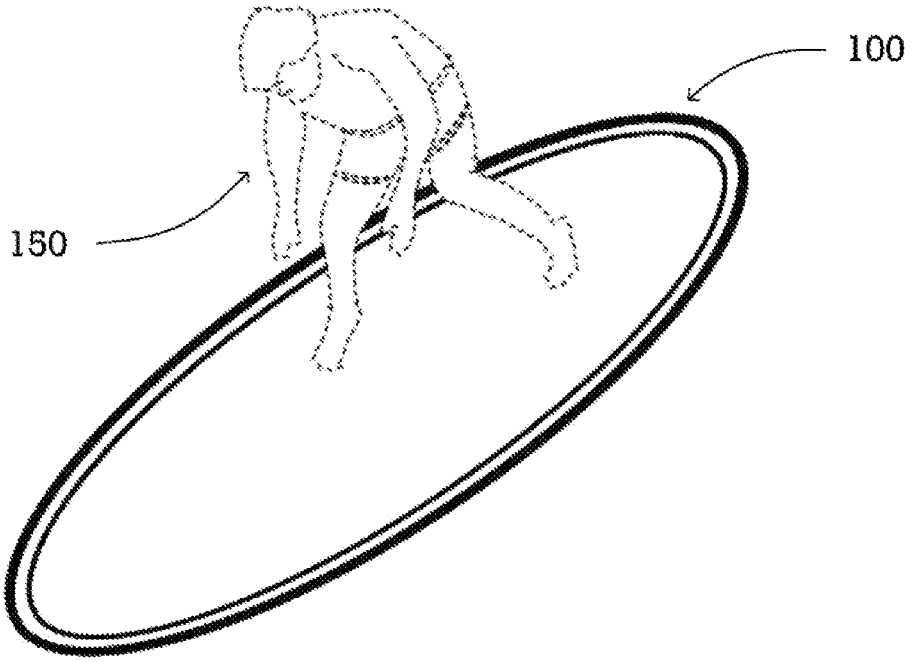
Figure 5I:
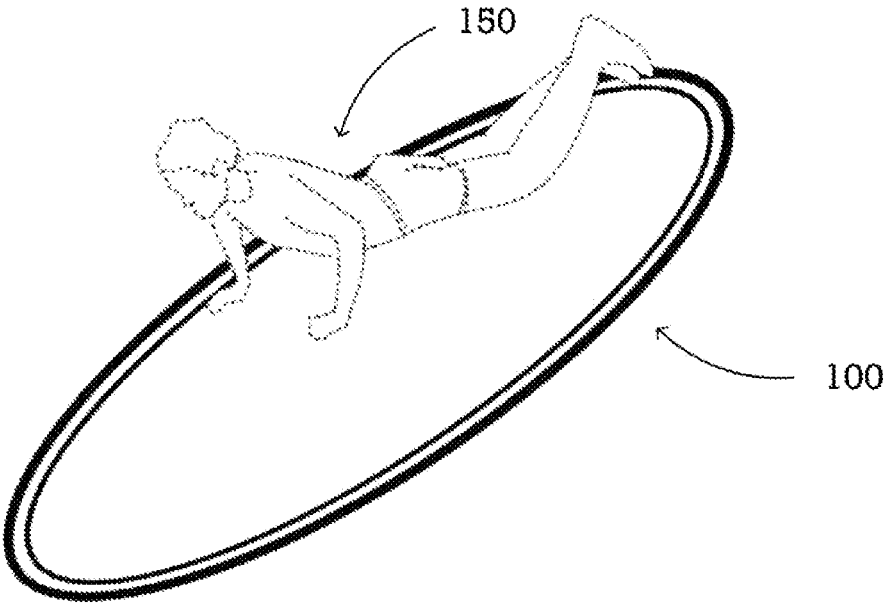

Subsequently, as shown on FIG. 5F, with the user 150 ⅓ up the machine (wave) his weight is fully resting on the back foot, front foot completely unweighted. The user 150's arms can be thrown up above the head to 'fly' back up the simulated wave face and keep the rotation of machine 100 going. Subsequently, at the time shown on FIG. 5G, ⅔ up the machine (wave face) user 150 can rotate around his backfoot rotating the upper body and front foot around to get into the initial position (5A) as shown in FIG. 5H again, with weight on the front foot going down the wave for another turn simulation.

Surf machine 100 can also include, in alternative embodiments, electrical motors and/or brakes (not shown) in order to more precisely control rotation, for example, for safety purpose, to replicate particular points on a wave, or to increase resistance for training and different wave characteristics. In another embodiment, the platform 120 can rotate around a central axle. A counterweight or counter lever with a support ring of the same size as the platform can be used to stabilize it. In all these and other alternatives, the platform can have a mechanical brake, and/or electric motor for safety, and to provide a more accurate simulation, resisting or enhancing motion along certain axes. With an electric motor or other sensors installed to track rotation and energy expended by the surfer, the energy output of the surfer can be measured, stored, displayed, and shared, for example, for tracking progress, for training/coaching and other purposes, such as social media.

Because some components of these described embodiments involve readily available apparatus (e.g. trampoline assembly 140), and other materials (e.g. plywood), it is contemplated that a kit to modify such components to achieve the objectives and implement the embodiments described herein. Thus, a manufacturer may desire to minimize manufacturing and distribution expenses by providing only an adapter including the necessary components which are not commercially available to users and instructions for fabricating and assembling the components to complete an apparatus along with commercially-available parts (e.g. a consumer-grade trampoline). In other embodiments, all components and materials may be provided in more or less complete form.

Figure 2:
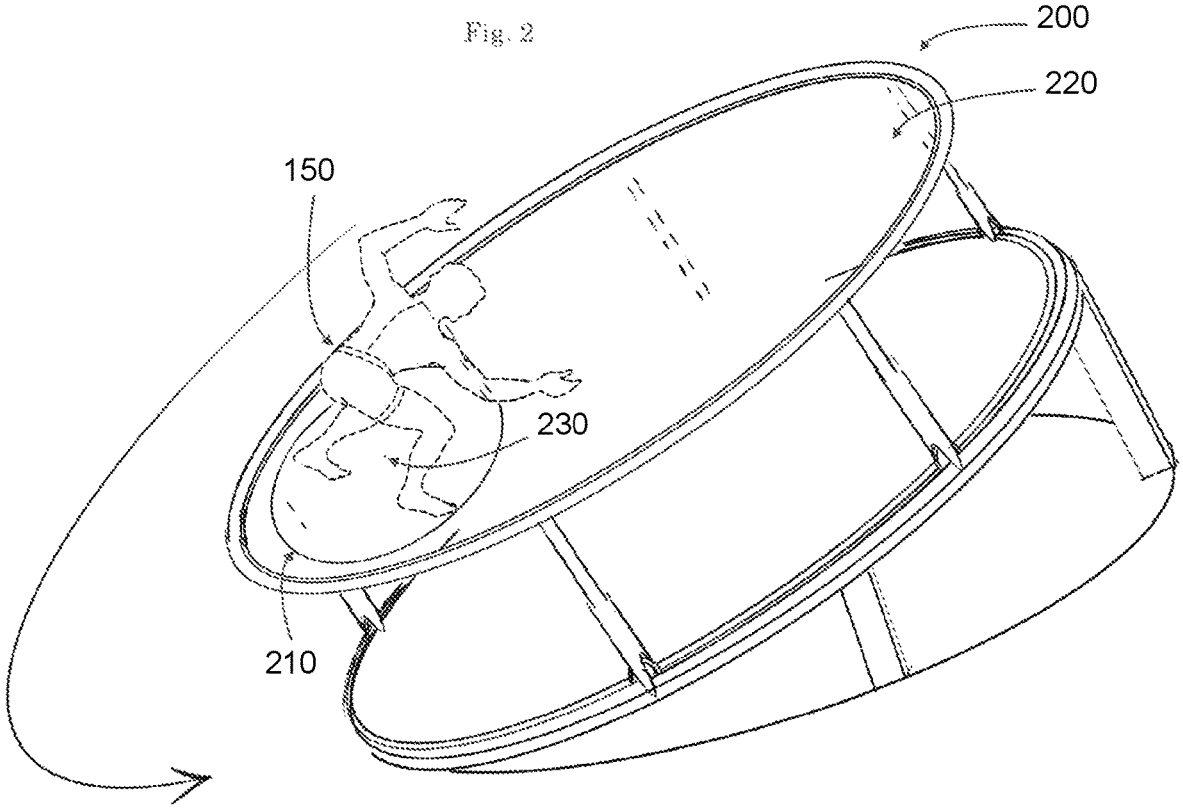
FIGS. 2-4D show various alternative embodiments of the surf machine.

An alternative embodiment of the present invention is shown as 200 in FIG. 2. Some details which have been described relative to FIG. 1 are present, but some labelling has been omitted for clarity. In this embodiment, a smaller rotating platform 210 is installed in or above surface 220 that itself can rotate on an axis 230. This makes the exercise more challenging, but also easier to 'feel' the board turn under surfer 150 and turn it on top of the platform (at the lip) to point the front foot back down again rotating clockwise around the backfoot. This can also simulate 360 degree maneuvers that are common in modern surfing. The platform can be circular in shape as shown, or other shapes (e.g. a surfboard shape) according to the type of training and simulation desired.

Figure 3:
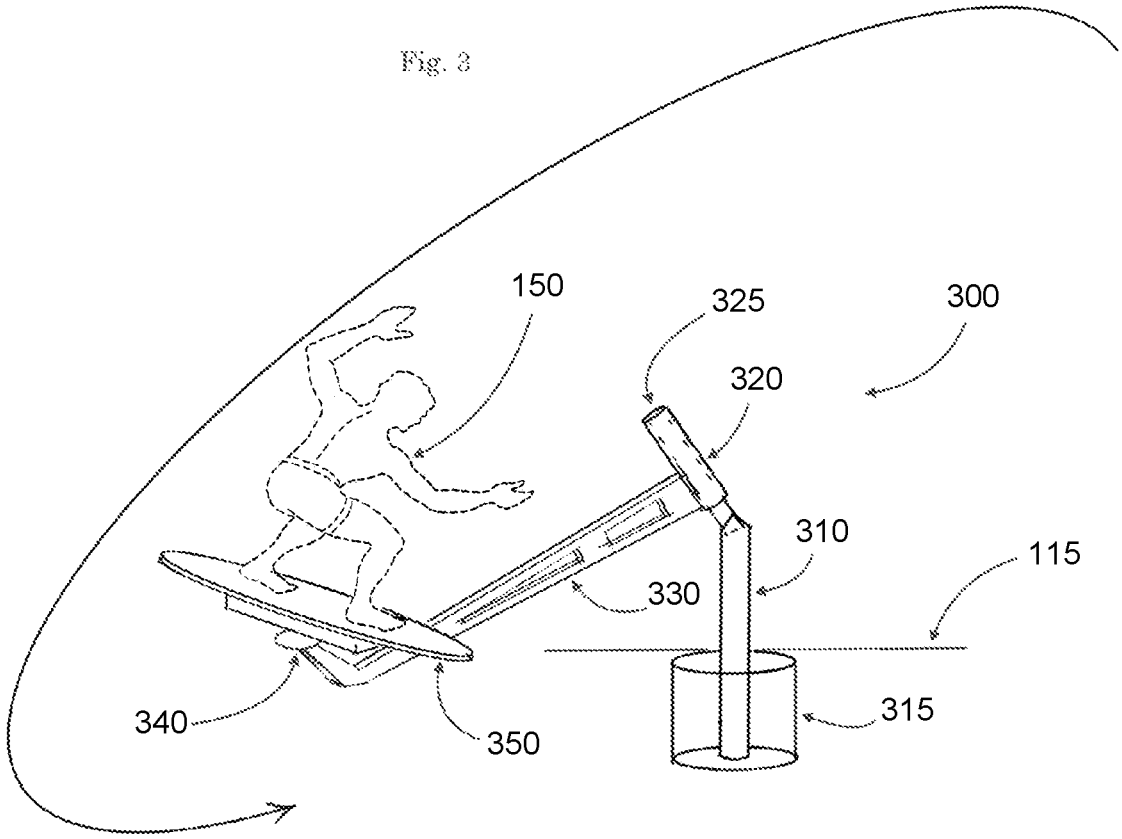

Yet another alternative embodiment is shown as surf machine 300 in FIG. 3 which may be useful in a more permanent installation. In this instance, a permanent or semi-permanent installation is contemplated. A central post 310 is set into surface 115 such that it is securely attached via a counter-weight or concrete base 315 sufficient to withstand rotation motion of the apparatus 300 with a surfer 150 riding it. Attached to post 310 is an angled axis 320 as a post about which the remaining apparatus can rotate. A bearing 325 of an arm 330 is rotatably coupled to post 320 to allow free rotation of the arm. Arm 330 extends away from post 320 to support a platform shaped as a board 350 which allows movement about an axis 340 at the end of the arm. This allows the surfer 150 to maneuver the board 350 to simulate movement of the board on water, and the arm swings to simulate motion on the wave. A combination of retention mechanisms (to restrict or stop motion along certain axes), as well as the aforementioned brakes, motors, sensors and the like can be used to achieve the objectives discussed above. Of course, because of the semi-permanent nature of this embodiment, accessibility to average surfers may be limited, but it may be useful where circumstances permit, for example, at a park where such activities are engaged in.

Figure 4A:
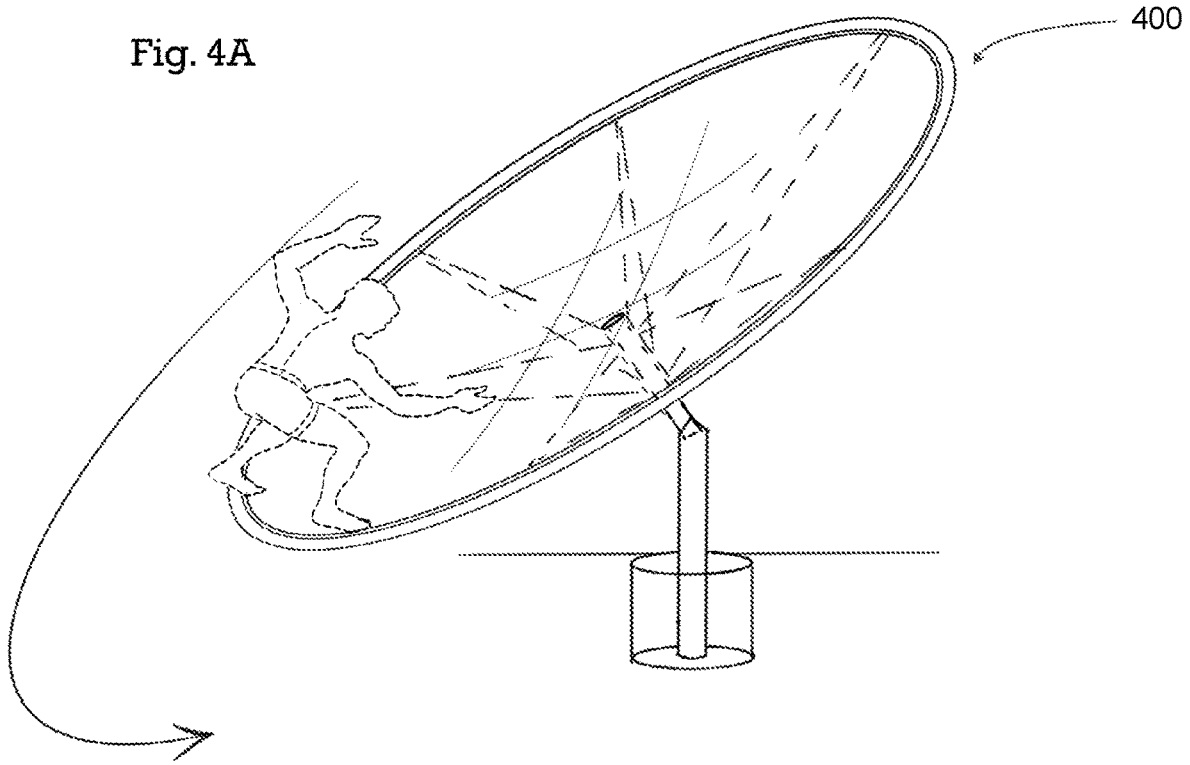
Figure 4B:
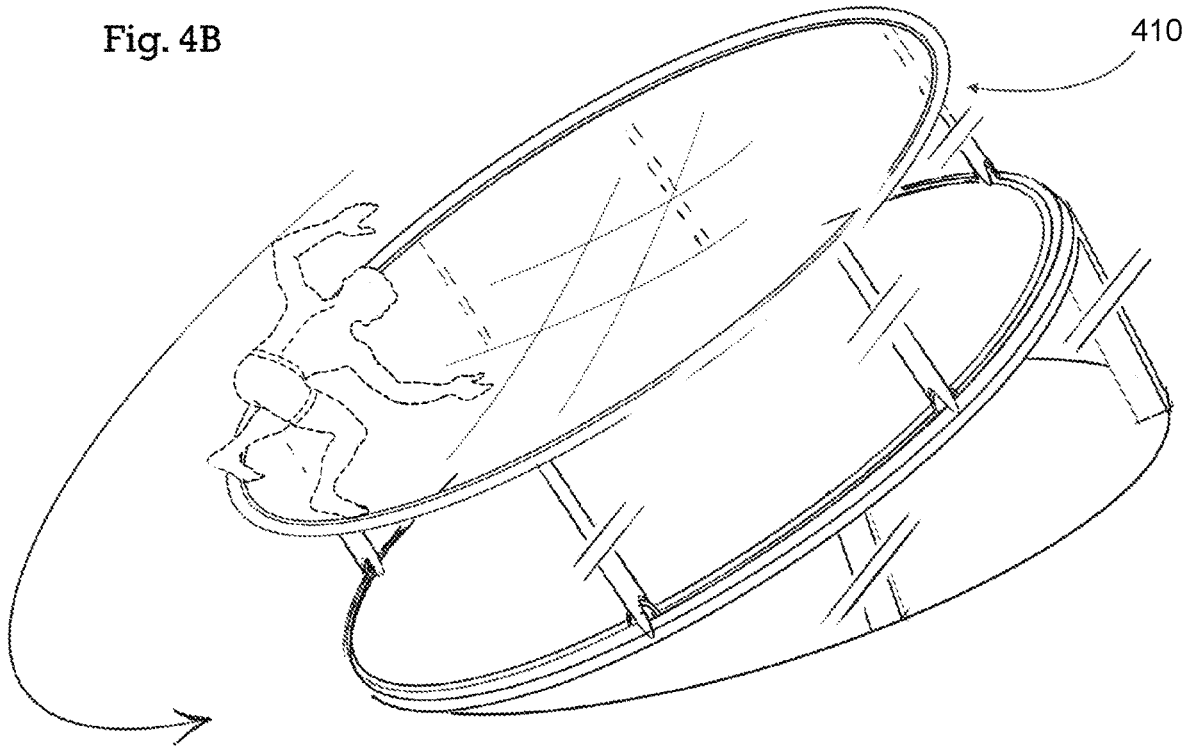
Figure 4C:
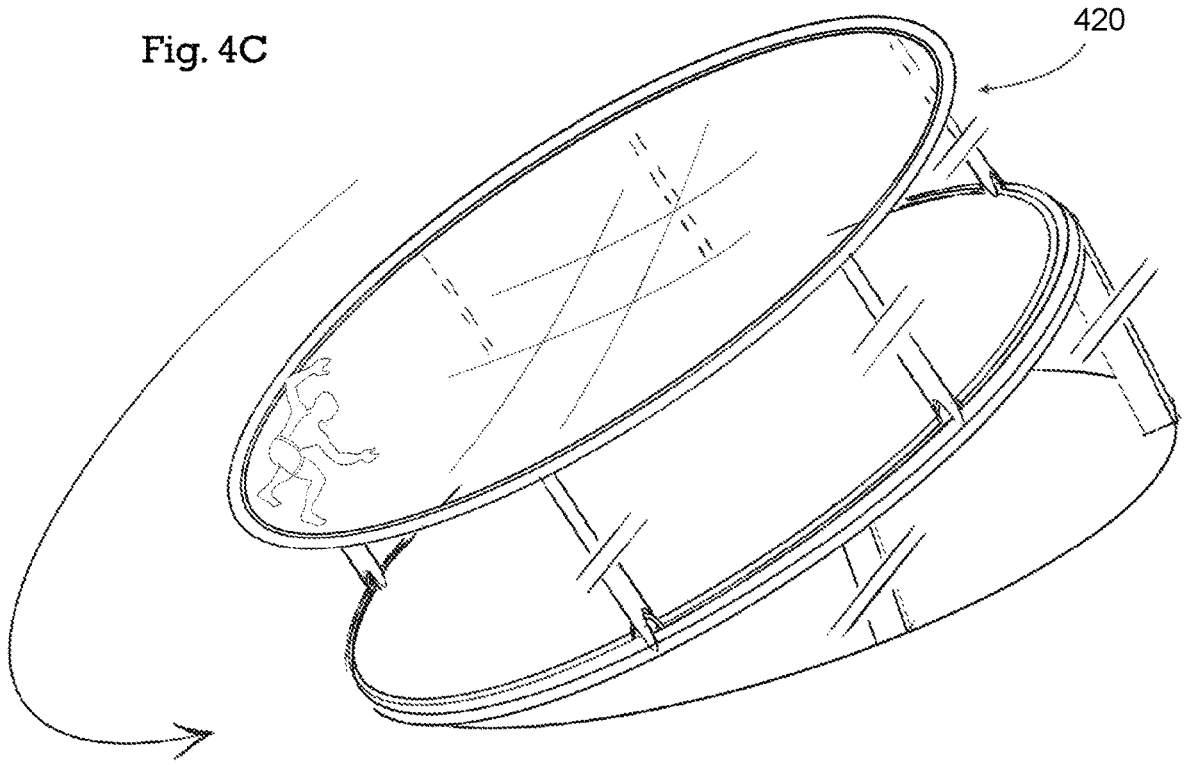

Other alternative embodiments of the present invention are shown in FIGS. 4A-4D. For example, 400 of FIG. 4A shows an embodiment of the present invention which combines an elastic surface with a single post to allow rotation. 410 and 420 of FIGS. 4B and 4C show the effect of varying the diameter of surf machine 100 for simulating different surfing conditions.

Figure 4D:
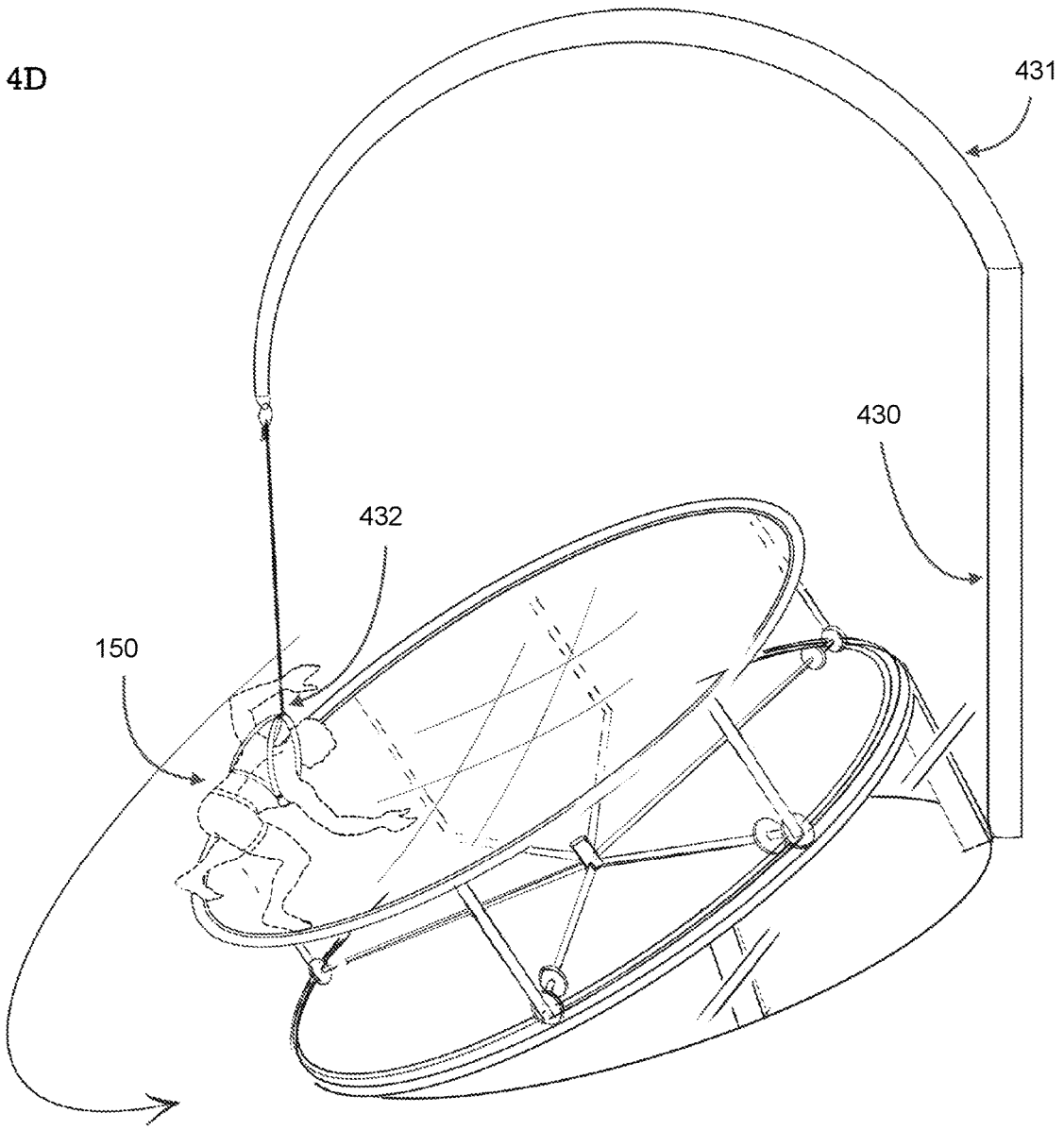

FIG. 4D shows yet another alternative embodiment 430 which can be used with any of the previously described embodiments to provide an additional margin of safety to surfer 150. In this embodiment, a support structure is solidly affixed nearby the apparatus 430 in such a way that the surfer 150 can be suspended. The user can wear a harness 432 suspended by support 431 to avoid injury from falls occurring during use of the surf machine. In addition to such a structure, it is contemplated that pads, nets, and related safety equipment can also be used in combination with any of the aforesaid apparatus.

Figure 6A:
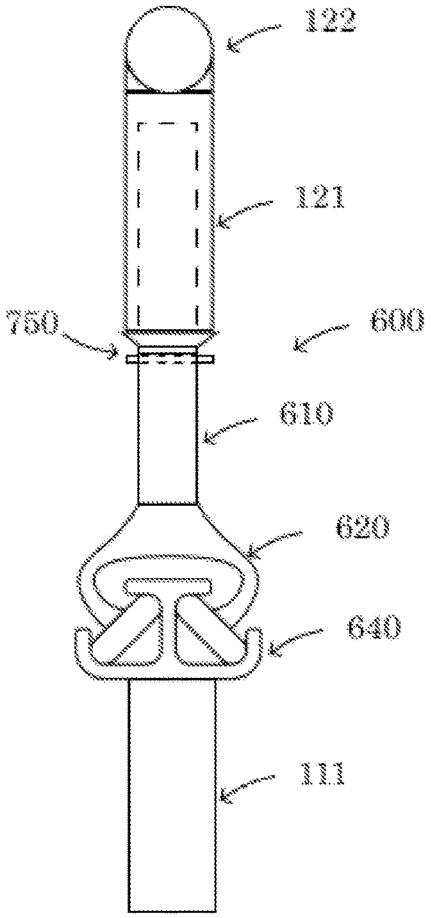
FIGS. 6A and 6B show a captured bearing attachment component which may be used for a captured rotation of a simulated wave surface in various embodiments of the present invention.
Figure 6B:
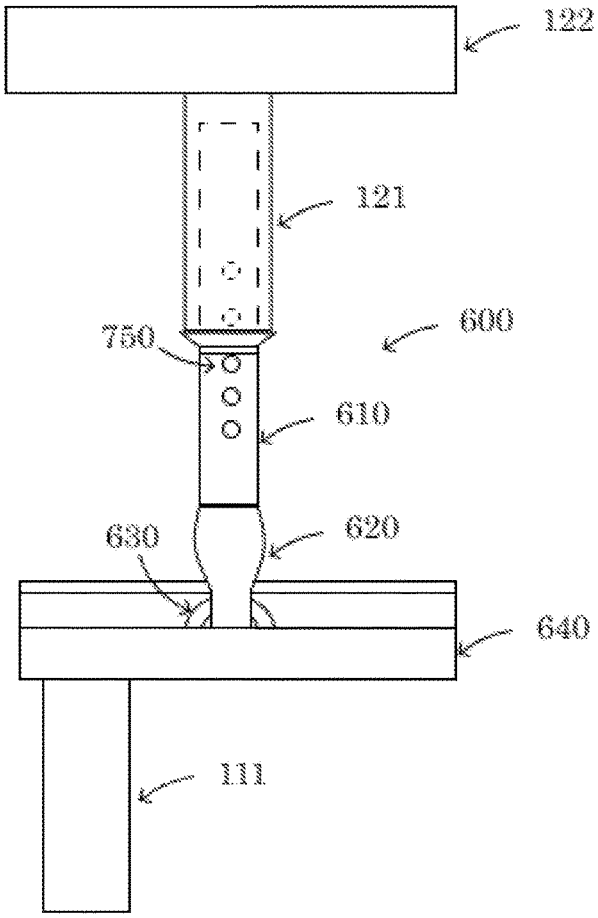

A captured bearing and stand subassembly which might be useful in embodiments of the present invention is shown as rolling support leg 600 shown in FIGS. 6A and 6B. Rolling support leg 600 may comprise an adjustable leg assembly 610 which may be used for adjusting the height of a surf machine 100. The leg may be coupled to support bearing assemblies 620 upon which may be mounted wheels 630. Wheels may be any of those commercially available wheels including bearings, such as skateboard or inline skate wheels. In this embodiment as shown, the wheels 630 may be captured in a track 640. Track 640 may form either the captured rotating base of machine 100 or the perimeter of trampoline assembly 140 to allow captured rotation. One skilled in the arts can configure such a component (or plurality of components) rolling support leg 600 in any number of ways to allow rotation and usage of the apparatus described herein.

Rolling support leg 600 inserts into shortened or extended legs 121 of the frame 122 or attach directly to the frame 122. A pin or screw connection 650 secures the leg assembly 610 inside the trampoline or platform leg 121. The wheels 630 run in a circular track 640 that is either mounted on or establishing the tilted surface 110.

Figure 7A:
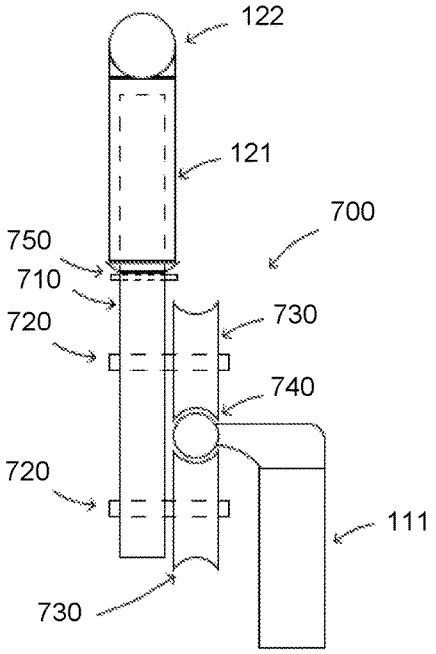
FIGS. 7A and 7B show an alternative embodiment of a captured bearing attachment component.
Figure 7B:
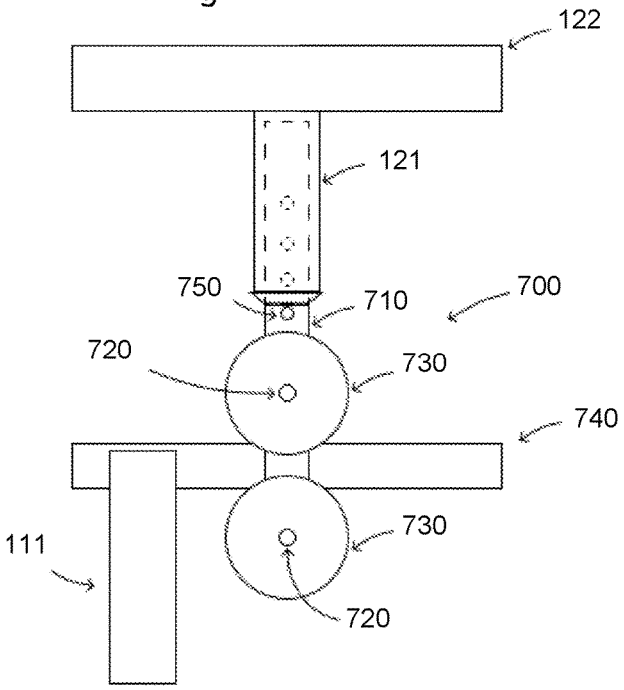

Another captured bearing and stand subassembly which might be useful in embodiments of the present invention is shown as rolling support leg 700 shown in FIGS. 7A and 7B. Rolling support leg 700 may comprise an adjustable leg assembly 710 which may be used for adjusting the height of a surf machine 100. The leg may be coupled to support bearing assemblies 720 upon which may be mounted an upper wheel 730 and a lower wheel 730 each of which may have concave tread surface. Wheels may be any of those commercially available wheels including bearings, such as skateboard or inline skate wheels. In this embodiment as shown, the wheels 730 may be captured and run on and under a track 740. Track 740 may form either the captured rotating base of machine 100 or the perimeter of trampoline assembly 140 to allow captured rotation. One skilled in the arts can configure such a component (or plurality of components) rolling support leg 700 in any number of ways to allow rotation and usage of the apparatus described herein. The bearing assembly may have two wheels on the top or bottom to ensure better alinement with the track.

Rolling support leg 700 inserts into shortened or extended legs 121 of the frame 122 or attach directly to the frame 122. A pin or screw connection 750 secures the leg assembly 710 inside the trampoline or platform leg 121. The wheels 730 run on a circular track 740 that is either mounted on or establishing the tilted surface 110.

Figure 8A:
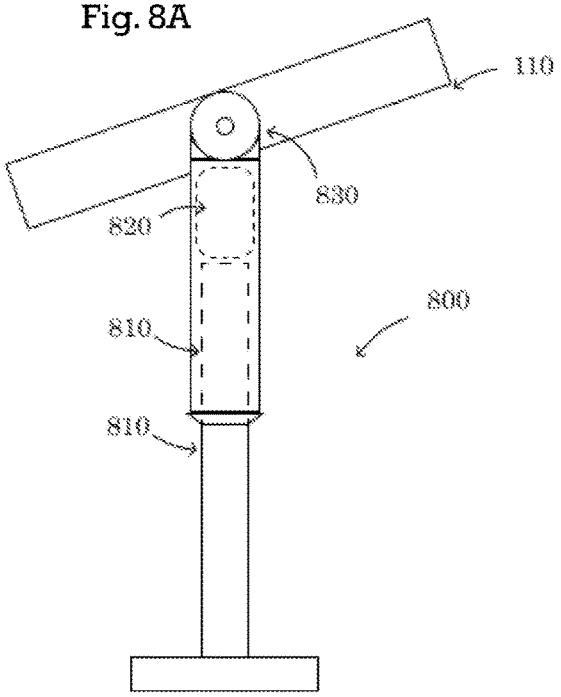
FIGS. 8A and 8B show a height adjustable leg in an embodiment of the present invention.
Figure 8B:
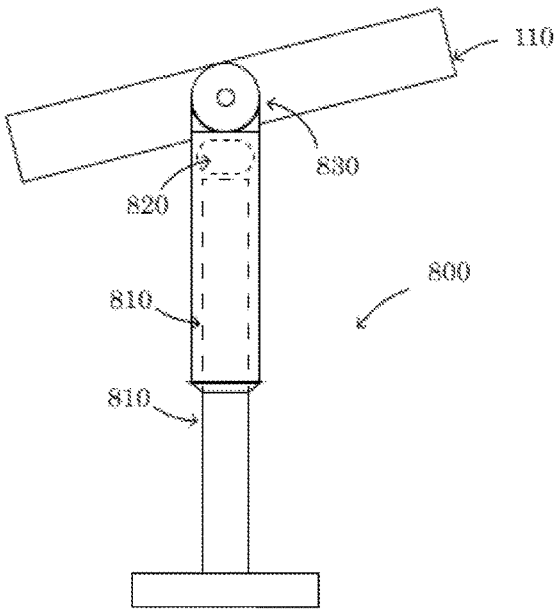

Another captured bearing and stand subassembly which might be useful in embodiments of the present invention is shown as height adjustable leg 800 shown in FIGS. 8A and 8B which are an embodiment of the leg 111 between the ground, floor or other solid surface 115 and the surface of rail 110. Height adjustable leg 800 may comprise an adjustable leg assembly 810 which may be used for adjusting the height of surf machine 100. The leg may be coupled to inflatable or shock absorber assemblies 820 upon which may be mounted a rotatable connection 830 to the surface or rail 110 to allow flexible tilt relative to the ground, floor or other solid surface 115 by which the simulation of changing steepness and energy of a wave is possible. FIG. 8A shows an extended leg setting with an inflatable or shock absorber assembly 820 which may be an airbag, electrically or mechanically driven gear, or set mechanically by a pin. FIG. 8B shows a short leg setting with a shortened inflatable or shock absorber assembly 820 which may be an airbag, electrically or mechanically driven gear, or set mechanically by a pin. One skilled in the arts can configure such a component (or plurality of components) height adjustable leg 800 in any number of ways to allow tilt adjustment and usage of the apparatus described herein.

Figure 9A:
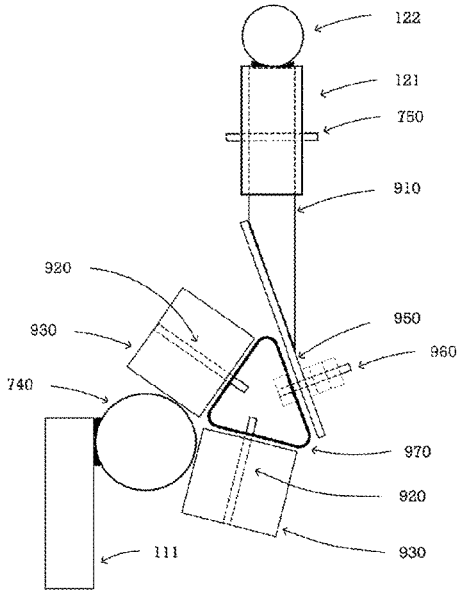
FIGS. 9A and 9B show another embodiment of a captured bearing attachment component.
Figure 9B:
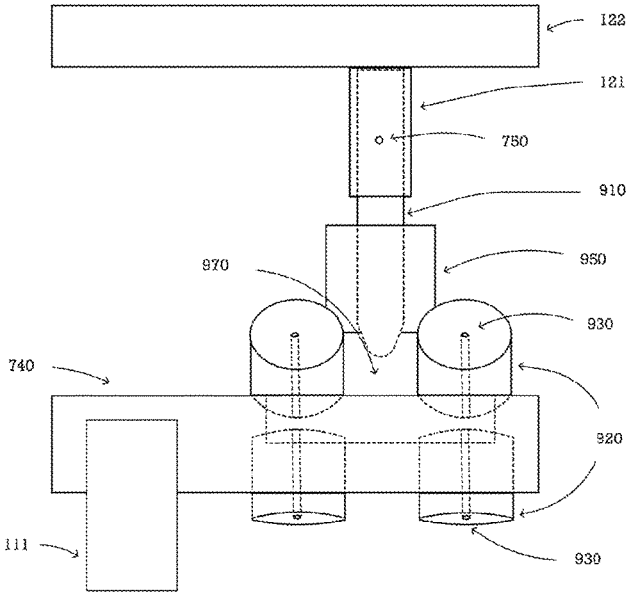

Yet another captured bearing and stand subassembly which might be useful in some embodiments of the present invention is shown as rolling support leg 900 shown in FIGS. 9A and 9B. Rolling support leg 900 may comprise an adjustable leg assembly 910 which may be used for adjusting the height of a surf machine 100. The leg may be coupled to support bearing assemblies 950 upon which may be mounted with a bolt in a rotatable fashion 960 a wheel assembly 970 which has two upper wheels 930 and two lower wheels 930 which form a concave V shape between each other in which the railing 740 sits. The wheeled leg can neither fall out nor pop up out of the railing if fitted properly. Wheels may be any of those commercially available wheels including bearings, such as skateboard or inline skate wheels. In this embodiment as shown, the wheels 930 may be captured and run on and under a track 740 in an angle. Track 740 may form either the captured rotating base of machine 100 or the perimeter of trampoline assembly 140 to allow captured rotation. One skilled in the art may configure such a component (or plurality of components) rolling support leg 900 in any number of ways to allow rotation and usage of the apparatus described herein. The bearing assembly may have two wheels on the top or bottom to ensure better alignment with the track.

Rolling support leg 900 inserts into shortened or extended legs 121 of the frame 122 or attach directly to the frame 122. A pin or screw connection 750 secures the leg assembly 910 inside the trampoline or platform leg 121. The wheels 930 run on a circular track 740 that is either mounted on or establishing the tilted surface 110.

Figure 10A:
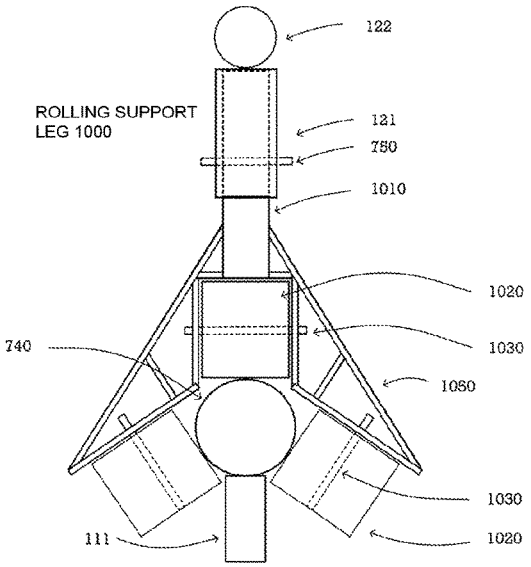
FIGS. 10A and 10B show another embodiment of a captured bearing attachment component.
Figure 10B:
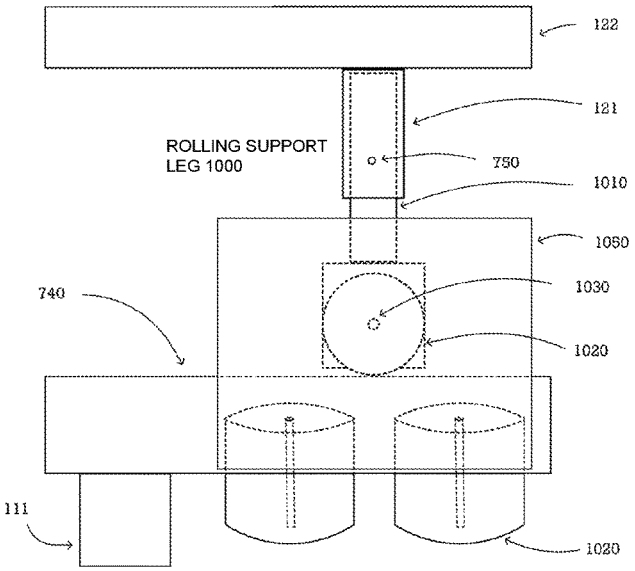

Yet another captured bearing and stand subassembly which might be useful in some embodiments of the present invention is shown as rolling support leg 1000 shown in FIGS. 10A and 10B. Rolling support leg 1000 may comprise an adjustable leg assembly 1010 which may be used for adjusting the height of a surf machine 100. The leg may be coupled to support bearing assemblies 1050 upon which may be mounted upper wheels 1030 (disposed within enclosure 1020) and two sets of lower wheels 1030 each of which is angled toward each other creating a channel wherein the rail 740 will be captured. Wheels may be any of those commercially available wheels including bearings, such as skateboard or inline skate wheels. In this embodiment as shown, the wheels 1030 may be captured and run on and under a track 740 at an angle. Track 740 may form either the captured rotating base of machine 100 or the perimeter of trampoline assembly 140 to allow captured rotation. One skilled in the art may configure such a component (or plurality of components) rolling support leg 1000 in any number of ways to allow rotation and usage of the apparatus described herein. The bearing assembly may have two wheels on the top or bottom to ensure better alinement with the track.

Rolling support leg 1000 inserts into shortened or extended legs 121 of the frame 122 or attach directly to the frame 122. A pin or screw connection 750 secures the leg assembly 1010 inside the trampoline or platform leg 121. The wheels 1030 run on a circular track 740 that is either mounted on or establishing the tilted surface 110.

Thus, a surf machine, a related adapter, subassemblies and methods for surfing simulation and training has been described. While the invention has been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims and claims which may ultimately be filed.

What is claimed is:

1. A platform-on-a-platform apparatus comprising:

a top platform that includes:

a) a surface capable of supporting a user;

b) a fixed-height support coupled to the surface for holding the surface, wherein the fixed height support comprises a plurality of same-height legs;

c) a bearing coupled to the fixed-height support for allowing the surface to rotate about an axis; and a bottom platform that includes:

d) a tilted stand upon which the top platform is disposed, the tilted stand being coupled to the bearing for securely supporting the bearing at an angle that is askew relative to level and allowing the top platform to rotate about a tilted axis, wherein the tilted axis is askew relative to level.

2. The platform-on-a-platform apparatus of claim 1 wherein the surface includes an elastic surface that is comprised of an elastic material.

3. The platform-on-a-platform of claim 2 wherein the surface comprises a trampoline.

4. The platform-on-a-platform of claim 3 wherein the plurality of same-height legs are coupled to the trampoline.

5. The platform-on-a-platform of claim 4 wherein the bearing comprises a plurality of wheels, at least one wheel of the plurality of wheels coupled to each of the plurality of legs.

6. The platform-on-a-platform of claim 5 wherein each of the plurality of wheels is configured to rest upon a solid surface of the bottom platform to support the top platform.

7. The platform-on-a-platform of claim 6 wherein the solid surface is set at the angle that is askew relative to level.

8. The platform-on-a-platform apparatus of claim 1 wherein the surface includes a firm surface that is comprised of a firm material.

9. The platform-on-a-platform apparatus of claim 1 wherein the tilted stand comprises a plurality of different-height legs coupled to the bearing.

10. The platform-on-a-platform apparatus of claim 9 wherein the different-height legs are user-adjustable to adjust the angle.

11. A method for using the platform-on-a-platform apparatus of claim 1 comprising the following steps:

a) a user standing atop the surface in a surfing stance;

b) the user shifting their weight back and forth to cause the top platform to rotate about the axis; and c) the user simulating surfing and maintaining balance doing the surfing stance while shifting the their weight.

12. The method of claim 11 further comprising the step of the user maintaining the surfing stance until the apparatus does one full rotation and the user rotating their body 180 degrees when commencing an additional rotation of the platform-on-a-platform apparatus.

13. A platform-on-a-platform apparatus configured to be coupled to a trampoline, to create an apparatus to simulate surfing, the platform-on-a-platform apparatus comprising:

a top platform that includes:

a) a frame for coupling to a circular trampoline;

b) a fixed-height support coupled to the frame, wherein the fixed-height support comprises a plurality of same-height legs for coupling to the trampoline;

c) a bearing coupled to the fixed height support for allowing the trampoline to rotate about an axis; and a bottom platform that includes:

d) a tilted stand upon which the top platform is disposed, the tilted stand being coupled to the bearing for securely supporting the bearing at an angle that is askew relative to level and allowing the top platform to rotate about a tilted axis, wherein the tilted axis is askew relative to level.

14. The apparatus of claim 13 wherein the bearing comprises a plurality of wheels, at least one wheel of the plurality of wheels coupled to each of the plurality of same-height legs.

15. The apparatus of claim 14 wherein each of the plurality of wheels is configured to rest upon the tilted stand and the tilted stand comprises a solid surface to support the top platform.

16. The apparatus of claim 15 wherein the tilted stand comprises a plurality of different-sized legs coupled to the solid surface.

17. The apparatus of claim 16 wherein the different-sized legs are user-adjustable to adjust the angle.

* * * * *